US008790493B2

(12) United States Patent
Solhage et al.

(10) Patent No.: US 8,790,493 B2
(45) Date of Patent: Jul. 29, 2014

(54) PROCESS FOR THE PRODUCTION OF PAPER

(71) Applicant: Akzo Nobel N.V., Arnhem (NL)

(72) Inventors: Fredrik Solhage, Borås (SE); Joakim Carlén, Göteborg (SE); Birgitta Johansson, Pràssebo (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 13/648,779

(22) Filed: Oct. 10, 2012

(65) Prior Publication Data

US 2013/0277002 A1 Oct. 24, 2013

Related U.S. Application Data

(63) Continuation of application No. 13/099,752, filed on May 3, 2011, now Pat. No. 8,308,903, which is a continuation of application No. 11/302,941, filed on Dec. 14, 2005, now Pat. No. 7,955,473.

(60) Provisional application No. 60/638,183, filed on Dec. 22, 2004.

(51) Int. Cl.

| | |
|---|---|
| ***D21H 21/10*** | (2006.01) |
| ***D21H 17/34*** | (2006.01) |
| ***D21H 17/63*** | (2006.01) |
| ***D21H 17/66*** | (2006.01) |
| ***D21H 17/68*** | (2006.01) |

(52) U.S. Cl.
USPC ..... 162/168.3; 162/158; 162/164.1; 162/164.6; 162/181.2; 162/181.6; 162/185

(58) Field of Classification Search
USPC ..... 162/158, 164.1, 164.6, 168.3, 162/181.1–181.7, 183, 185
See application file for complete search history.

(56) References Cited

U.S. PATENT DOCUMENTS

| | | | | |
|---|---|---|---|---|
| 4,066,495 | A | 1/1978 | Voigt et al. | |
| 4,305,781 | A | 12/1981 | Langley et al. | 162/164 R |
| 4,388,150 | A | 6/1983 | Sunden et al. | 162/175 |
| 4,749,444 | A | 6/1988 | Lorz et al. | 162/168.3 |
| 4,750,974 | A | 6/1988 | Johnson | |
| 4,753,710 | A | 6/1988 | Langley et al. | |
| 4,795,531 | A | 1/1989 | Sofia et al. | |
| 4,913,775 | A * | 4/1990 | Langley et al. | 162/164.3 |
| 4,927,498 | A | 5/1990 | Rushmere | 162/168.3 |
| 4,954,220 | A | 9/1990 | Rushmere | 162/168.3 |
| 4,961,825 | A | 10/1990 | Andersson et al. | 162/175 |
| 4,980,025 | A | 12/1990 | Andersson et al. | 162/168.3 |
| 5,071,512 | A | 12/1991 | Bixler et al. | |
| 5,127,994 | A | 7/1992 | Johansson | 162/168.3 |
| 5,167,766 | A | 12/1992 | Honig et al. | 162/164.1 |
| 5,171,808 | A | 12/1992 | Ryles et al. | |
| 5,176,891 | A | 1/1993 | Rushmere | 423/328.1 |
| 5,185,061 | A | 2/1993 | Lowry et al. | |
| 5,368,833 | A | 11/1994 | Johansson et al. | 423/338 |
| 5,447,604 | A | 9/1995 | Johansson et al. | 162/181.6 |
| 5,470,435 | A | 11/1995 | Rushmere et al. | 162/181.6 |
| 5,501,771 | A | 3/1996 | Bourson | |
| 5,529,699 | A | 6/1996 | Kuo et al. | |
| 5,543,014 | A | 8/1996 | Rushmere et al. | 162/181.6 |
| 5,571,494 | A | 11/1996 | Saastamoinen | 423/338 |
| 5,573,674 | A | 11/1996 | Lind et al. | 210/702 |
| 5,584,966 | A | 12/1996 | Moffett | 162/168.1 |
| 5,595,629 | A | 1/1997 | Begala | 162/158 |
| 5,595,630 | A | 1/1997 | Moffett | 162/164.1 |
| 5,603,805 | A | 2/1997 | Andersson et al. | 162/168.3 |
| 5,607,552 | A | 3/1997 | Andersson et al. | |
| 5,676,796 | A | 10/1997 | Cutts | 162/158 |
| 5,688,482 | A | 11/1997 | Saastamoinen | 423/335 |
| 5,707,493 | A | 1/1998 | Saastamoinen | 162/164.1 |
| 5,846,384 | A | 12/1998 | Schold et al. | |
| 5,858,174 | A | 1/1999 | Persson et al. | |
| 5,876,563 | A * | 3/1999 | Greenwood | 162/175 |
| 6,033,525 | A | 3/2000 | Moffett | |
| 6,083,348 | A | 7/2000 | Auhorn et al. | |
| 6,100,322 | A * | 8/2000 | Persson et al. | 524/418 |
| 6,103,064 | A | 8/2000 | Asplund et al. | 162/168.3 |
| 6,103,065 | A * | 8/2000 | Humphreys et al. | 162/181.8 |
| 6,168,686 | B1 | 1/2001 | Sutman et al. | 162/142 |

(Continued)

FOREIGN PATENT DOCUMENTS

| | | |
|---|---|---|
| EP | 0 234 513 B1 | 9/1987 |
| EP | 0 235 893 A1 | 9/1987 |

(Continued)

OTHER PUBLICATIONS

Sears, Jr., G., "Determination of Specific Surface Area of Colloidal Silica by Titration with Sodium Hydroxide," Analytical Chem., vol. 28, No. 12 (1956), pp. 1981-1983.

Iler et al., "Degree of Hydration of Particles of Colloidal Silica in Aqueous Solution," J. Phys. Chem., vol. 60, (1956), pp. 955-957.

Japanese Office Action for Japanese Application No. 2007-548139 dated Feb. 9, 2010.

English Language Translation of the Japanese Office Action for Japanese Application No. 2007-548139 dated Feb. 9, 2010.

Taiwanese Examination Report for Taiwan Patent Application No. 95148730, 1999.

(Continued)

*Primary Examiner* — Dennis Cordray
(74) *Attorney, Agent, or Firm* — Robert C. Morriss

(57) ABSTRACT

The present invention relates to a process for producing paper which comprises:

(vii) providing an aqueous suspension comprising cellulosic fibers, (viii) adding to the suspension after all points of high shear a first polymer being a cationic polymer having a charge density above 2.5 meq/g;

a second polymer, and a third polymer being an organic or inorganic anionic polymer; and (ix) dewatering the obtained suspension to form paper.

17 Claims, No Drawings

(56) References Cited

U.S. PATENT DOCUMENTS

| | | | | |
|---|---|---|---|---|
| 6,273,998 | B1 | 8/2001 | Kuo et al. | |
| 6,372,089 | B1 | 4/2002 | Keiser et al. | |
| 6,379,500 | B2 * | 4/2002 | Greenwood et al. | 162/181.6 |
| 6,379,501 | B1 * | 4/2002 | Zhang et al. | 162/181.7 |
| 6,406,593 | B1 | 6/2002 | Heard et al. | |
| 6,444,091 | B1 | 9/2002 | Ward et al. | |
| 6,454,902 | B1 | 9/2002 | Chen | 162/168.1 |
| 6,524,439 | B2 * | 2/2003 | Chen et al. | 162/168.1 |
| 6,551,457 | B2 * | 4/2003 | Westman et al. | 162/158 |
| 6,770,170 | B2 | 8/2004 | Covarrubias | |
| 7,955,473 | B2 | 6/2011 | Solhage et al. | |
| 8,273,216 | B2 | 9/2012 | Solhage et al. | |
| 8,308,903 | B2 | 11/2012 | Solhage et al. | |
| 2002/0066540 | A1 | 6/2002 | Chen et al. | |
| 2002/0198306 | A1 | 12/2002 | Carr et al. | |
| 2003/0065041 | A1 | 4/2003 | Keiser et al. | |
| 2003/0136534 | A1 | 7/2003 | Johansson-Vestin et al. | |
| 2003/0139517 | A1 | 7/2003 | Nyander et al. | |
| 2003/0168192 | A1 | 9/2003 | Mohammed | |
| 2005/0247420 | A1 | 11/2005 | Blum et al. | |
| 2006/0130991 | A1 | 6/2006 | Solhage et al. | |
| 2006/0142429 | A1 | 6/2006 | Gelman et al. | |
| 2006/0142430 | A1 | 6/2006 | Harrington et al. | |

FOREIGN PATENT DOCUMENTS

| | | | | |
|---|---|---|---|---|
| EP | 0 335 575 | A2 | 10/1989 | |
| EP | 0 490 425 | B1 | 6/1992 | |
| EP | 0 522 940 | B1 | 1/1993 | |
| EP | 0 790 351 | A2 | 8/1997 | |
| EP | 0 790 351 | A3 | 8/1997 | |
| EP | 1 039 026 | B1 | 9/2000 | D21H 23/76 |
| EP | 1 238 161 | B1 | 9/2002 | D21H 23/76 |
| EP | 1 460 041 | A2 | 9/2004 | |
| EP | 1 460 041 | A3 | 9/2004 | |
| EP | 1 529 133 | B1 | 5/2005 | |
| JP | 01-162897 | A | 6/1989 | |
| JP | 2002-513102 | A | 5/2002 | |
| TW | 200400305 | | 1/2004 | |
| TW | 200426275 | | 12/2004 | |
| WO | WO 91/07543 | A1 | 5/1991 | |
| WO | WO 95/33097 | A1 | 12/1995 | |
| WO | WO 97/04168 | A1 | 2/1997 | |
| WO | WO 98/56715 | A1 | 12/1998 | |
| WO | WO 99/14432 | A1 | 3/1999 | |
| WO | WO 99/55962 | A2 | 11/1999 | |
| WO | WO 00/06490 | A1 | 2/2000 | |
| WO | WO 00/11267 | A1 | 3/2000 | |
| WO | WO 01/34910 | A1 | 5/2001 | |
| WO | WO 02/33171 | A1 | 4/2002 | |
| WO | WO 02/101145 | A1 | 12/2002 | |
| WO | WO 03/064767 | A1 | 8/2003 | |
| WO | WO 2004/015200 | A1 | 2/2004 | D21H 23/18 |
| WO | WO2004/015200 | A1 | 2/2004 | |
| WO | WO 2004/104299 | A1 | 12/2004 | |
| WO | WO 2005/116336 | A1 | 12/2005 | D21H 23/76 |

OTHER PUBLICATIONS

English language translation of Taiwanese Examination Report for Taiwan Patent Application No. 95148730.

Wurzburg, "Modified Starches: Properties and Uses", CRC Press, Boca Raton, FL, 2000, pp. 113-116.

USPTO Non-Final Office Action dated Apr. 14, 2009 relating to case U.S. Appl. No. 11/642,390, filed Dec. 20, 2006.

USPTO Final Office Action dated Jan. 4, 2010 relating to case U.S. Appl. No. 11/642,390, filed Dec. 20, 2006.

USPTO Non-Final Office Action dated Oct. 14, 2010 relating to case U.S. Appl. No. 11/642,390, filed Dec. 20, 2006.

Greenberg, S. A., "The Chemistry of Silicic Acid," Journal of Chemical Education, vol. 36, No. 5, 1959, pp. 218-219.

Falcone, J. "Silicon Compounds: Anthropogenic Silicas and Silicates", Kirk-Othmer Encyclopedia of Chemical Technology Copyright © 2001 by John Wiley & Sons, Inc., pp. 1-6.

"Bentonite", product information sheet, Arokor Holdings, Inc. [online] [retrieved from teh Internet: <URL: http://chemical21.com/industrialchem/inorganic/BENTONITE.htm>.

USPTO Non-Final Office Action dated Sep. 11, 2013 relating to U.S. Appl. No. 13/648,779, filed Oct. 10, 2012.

International Search Report No. PCT/SE2006/050090 dated Dec. 4, 2006.

"Retention/drainage technology reduces chemical cost" Goliath Business News, 2005, 2 pages [online] Retrieved from the Internet [Retrieved Jul. 20, 2011].

"EKA NP Series Compozil retention systems", product sheet, Akzo Nobel Pulp and Paper/EKA Chemicals, no date, 2 pages [online] Retrieved from the Internet [Retrieved Jul. 20, 2011].

Definition of "colloid", Websters II New Riverside University Dictionary, Houghton Mifflin Company, 1988, p. 282.

Lai et al., "More effective retention system . . . Time of the Chemicals," The World Pulp and Paper Week, Jun. 2002, p. 200-205.

Stratton, "Effect of agitation on polymer additives," Tappi Journal, Mar. 1983, p. 141-144.

Kartong, Sample tests Eka PL 1510 as to viscosity, charge density, conductivity, ph and moisture content, Apr. 29, 2003.

Product flyer for Eka PL 1510, Mar. 1, 2000, 1 sheet.

* cited by examiner

PROCESS FOR THE PRODUCTION OF PAPER

This application is a continuation of U.S. application Ser. No. 13/099,752, filed May 3, 2011, U.S. Pat. No. 8,308,903, which is a continuation of U.S. application Ser. No. 11/302,941, filed Dec. 14, 2005, U.S. Pat. No. 7,955,473, which claims priority based on U.S. Provisional Patent Application No. 60/638,183, filed Dec. 22, 2004.

FIELD OF THE INVENTION

The present invention relates to a process for the production of paper. More specifically, the invention relates to a process for the production of paper which comprises adding first, second and third polymers to an aqueous cellulosic suspension after all points of high shear and dewatering the obtained suspension to form paper.

BACKGROUND OF THE INVENTION

In the art of papermaking, an aqueous suspension containing cellulosic fibres, and optional fillers and additives, referred to as stock, is fed through pumps, screens and cleaners, which subject the stock to high shear forces, into a headbox which ejects the stock onto a forming wire. Water is drained from the stock through the forming wire so that a wet web of paper is formed on the wire, and the web is further dewatered and dried in the drying section of the paper machine. Drainage and retention aids are conventionally introduced at different points in the flow of stock in order to facilitate drainage and increase adsorption of fine particles such as fine fibres, fillers and additives onto the cellulose fibres so that they are retained with the fibres on the wire. Examples of conventionally used drainage and retention aids include organic polymers, inorganic materials, and combinations thereof.

U.S. Pat. No. 6,103,065 discloses a method for improving the retention and drainage of papermaking furnish comprising the steps of adding at least one cationic high charge density polymer of molecular weight 100,000 to 2,000,000 to said furnish after the last point of high shear; adding at least one polymer having a molecular weight greater than 2,000,000; and adding a swellable bentonite clay.

EP 1 238 161 B1 discloses a process for making paper or paper board in which a cellulosic suspension is flocculated by addition to a thin stock stream of the cellulosic suspension of a substantially water-soluble cationic synthetic polymer of intrinsic viscosity of at least 4 dl/g, wherein the flocculated cellulosic suspension is subjected to mechanical shearing and then reflocculated by addition subsequent to the centri-screen of a reflocculating system comprising (i) a siliceous material and (ii) a substantially water soluble anionic polymer of intrinsic viscosity of at least 4 dl/g. The process is claimed to provide improvements in retention and drainage.

WO 2004/015200 discloses a method for producing paper and board by shearing the paper material, adding a microparticle system made of cationic polymers and a fine-particle inorganic component to the paper material following the last shearing step before agglomerating the material, dewatering the paper material so as to form sheets, and drying said sheets. The method is claimed to provide improvements in retention and drainage.

It would be advantageous to be able to provide a papermaking process with further improvements in drainage, retention and formation.

SUMMARY OF THE INVENTION

The present invention is directed to a process for producing paper which comprises:

(i) providing an aqueous suspension comprising cellulosic fibres, (ii) adding to the suspension after all points of high shear:

- a first polymer being a cationic polymer having a charge density above 4.0 meq/g;
- a second polymer having a molecular weight above 500,000; and
- a third polymer being an anionic polymer; and (iii) dewatering the obtained suspension to form paper.

The present invention is also directed to a process for producing paper which comprises:

(i) providing an aqueous suspension comprising cellulosic fibres, (ii) adding to the suspension after all points of high shear:

- a first polymer being a cationic, acrylamide-based polymer having a charge density above 2.5 meq/g;
- a second polymer being an acrylamide-based polymer having a molecular weight above 500,000; and
- a third polymer being an anionic polymer; and (iii) dewatering the obtained suspension to form paper.

The present invention is further directed to a process for producing paper which comprises:

(i) providing an aqueous suspension comprising cellulosic fibres, (ii) adding to the suspension after all points of high shear:

- a first polymer being a cationic polymer having a charge density above 2.5 meq/g;
- a second polymer being a water-dispersible polymer; and
- a third polymer being an anionic polymer; and (iii) dewatering the obtained suspension to form paper.

DETAILED DESCRIPTION OF THE INVENTION

According to the present invention it has been found that drainage and retention can be improved without any significant impairment of formation, or even with improvements in paper formation, by a process which comprises adding drainage and retention aids comprising first, second and third polymers to a cellulosic suspension after all points of high shear and then dewatering the obtained suspension to form paper. The present invention provides improvements in drainage and retention in the production of paper from all types of stocks, in particular stocks containing mechanical or recycled pulp, and stocks having high contents of salts (high conductivity) and colloidal substances, and in papermaking processes with a high degree of white water closure, i.e. extensive white water recycling and limited fresh water supply. Hereby the present invention makes it possible to increase the speed of the paper machine and to use lower dosages of polymers to give corresponding drainage and/or retention effects, thereby leading to an improved papermaking process and economic benefits.

The term "drainage and retention aids", as used herein, refers to two or more components which, when added to an aqueous cellulosic suspension, give better drainage and retention than is obtained when not adding the said two or more components.

The first polymer according to the present invention is a cationic polymer having a charge density of at least 2.5 meq/g, suitably at least 3.0 meq/g, preferably at least 4.0 meq/g. Suitably, the charge density is in the range of from 2.5 to 10.0, preferably from 3.0 to 8.5 meq/g.

The first polymer can be selected from inorganic and organic cationic polymers. Preferably, the first polymer is water-soluble. Examples of suitable first polymers include polyaluminium compounds, e.g. polyaluminium chlorides, polyaluminium sulphates, polyaluminium compounds containing both chloride and sulphate ions, polyaluminium silicate-sulphates, and mixtures thereof.

Further examples of suitable first polymers include cationic organic polymers, e.g. cationic acrylamide-based polymers; poly(diallyldialkyl ammonium halides), e.g. poly(diallyldimethyl ammonium chloride); polyethylene imines; polyamidoamines; polyamines; and vinylamine-based polymers. Examples of suitable cationic organic polymers include polymers prepared by polymerization of a water-soluble ethylenically unsaturated cationic monomer or, preferably, a monomer mixture comprising one or more water-soluble ethylenically unsaturated cationic monomers and optionally one or more other water-soluble ethylenically unsaturated monomers. Examples of suitable water-soluble ethylenically unsaturated cationic monomers include diallyldialkyl ammonium halides, e.g. diallyldimethyl ammonium chloride and cationic monomers represented by the general structural formula (I):

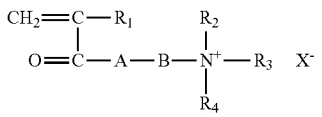

(I)

wherein $R_1$ is H or $CH_3$, $R_2$ and $R_3$ are each H or, preferably, a hydrocarbon group, suitably alkyl, having from 1 to 3 carbon atoms, preferably 1 to 2 carbon atoms; A is O or NH; B is an alkyl or alkylene group having from 2 to 8 carbon atoms, suitably from 2 to 4 carbon atoms, or a hydroxy propylene group; $R_4$ is H or, preferably, a hydrocarbon group, suitably alkyl, having from 1 to 4 carbon atoms, preferably 1 to 2 carbon atoms, or a substituent containing an aromatic group, suitably a phenyl or substituted phenyl group, which can be attached to the nitrogen by means of an alkylene group usually having from 1 to 3 carbon atoms, suitably 1 to 2 carbon atoms, suitable $R_4$ including a benzyl group ($—CH_2—C_6H_5$); and $X^-$ is an anionic counterion, usually a halide like chloride.

Examples of suitable monomers represented by the general structural formula (I) include quaternary monomers obtained by treating dialkylaminoalkyl (meth)acrylates, e.g. dimethylaminoethyl (meth)acrylate, diethylaminoethyl (meth)acrylate and dimethylaminohydroxypropyl (meth)acrylate, and dialkylaminoalkyl (meth)acrylamides, e.g. dimethylaminoethyl (meth)acrylamide, diethylaminoethyl (meth)acrylamide, dimethylaminopropyl (meth)acrylamide, and diethylaminopropyl (meth)acrylamide, with methyl chloride or benzyl chloride. Preferred cationic monomers of the general formula (I) include dimethylaminoethyl acrylate methyl chloride quaternary salt, dimethylaminoethyl methacrylate methyl chloride quaternary salt, dimethylaminoethyl acrylate benzyl chloride quaternary salt and dimethylaminoethyl methacrylate benzyl chloride quaternary salt.

The monomer mixture can contain one or more water-soluble ethylenically unsaturated non-ionic monomers. Examples of suitable copolymerizable non-ionic monomers include acrylamide and acrylamide-based monomers, e.g. methacrylamide, N-alkyl (meth)acrylamides, e.g. N-methyl (meth)acrylamide, N-ethyl (meth)acrylamide, N-n-propyl (meth)acrylamide, N-isopropyl (meth)acrylamide, N-n-butyl (meth)acrylamide, N-t-butyl (meth)acrylamide and N-isobutyl (meth)acrylamide; N-alkoxyalkyl (meth)acrylamides, e.g. N-n-butoxymethyl (meth)acrylamide, and N-isobutoxymethyl (meth)acrylamide; N,N-dialkyl (meth)acrylamides, e.g. N,N-dimethyl (meth)acrylamide; dialkylaminoalkyl (meth) acrylamides; acrylate-based monomers like dialkylaminoalkyl (meth)acrylates; and vinylamines. The monomer mixture can also contain one or more water-soluble ethylenically unsaturated anionic or potentially anionic monomers, preferably in minor amounts. The term "potentially anionic monomer", as used herein, is meant to include a monomer bearing a potentially ionisable group which becomes anionic when included in a polymer on application to the cellulosic suspension. Examples of suitable copolymerizable anionic and potentially anionic monomers include ethylenically unsaturated carboxylic acids and salts thereof, e.g. (meth) acrylic acid and salts thereof, suitably sodium (meth)acrylate, ethylenically unsaturated sulphonic acids and salts thereof, e.g. 2-acrylamido-2-methylpropanesulphonate, sulphoethyl-(meth)acrylate, vinylsulphonic acid and salts thereof, styrenesulphonate, and paravinyl phenol (hydroxy styrene) and salts thereof. Examples of preferred copolymerizable monomers include acrylamide and methacrylamide, i.e. (meth) acrylamide, and examples of preferred cationic organic polymers include cationic acrylamide-based polymer, i.e. a cationic polymer prepared from a monomer mixture comprising one or more of acrylamide and acrylamide-based monomers.

The first polymer in the form of a cationic organic polymer can have a weight average molecular weight of at least 10,000, often at least 50,000. More often, it is at least 100,000 and usually at least about 500,000, suitably at least about 1 million and preferably above about 2 million. The upper limit is not critical; it can be about 30 million, usually 20 million.

The second polymer according to the present invention is preferably an organic polymer which can be selected from non-ionic, cationic, anionic and amphoteric polymers. The second polymer can be water-soluble or water-dispersible. Suitably, the second polymer is prepared by polymerization of one or more ethylenically unsaturated monomers, preferably one or more water-soluble ethylenically unsaturated monomers. Examples of preferred second polymers include acrylamide-based polymers.

Examples of suitable second polymers include water-soluble and water-dispersible non-ionic organic polymers obtained by polymerizing one or more water-soluble ethylenically unsaturated non-ionic monomers. Examples of suitable non-ionic monomers include acrylamide and the above-mentioned non-ionic acrylamide-based and acrylate-based monomers and vinylamines. Examples of preferred non-ionic monomers include acrylamide and methacrylamide, i.e., (meth)acrylamide, and examples of preferred second polymers include non-ionic acrylamide-based polymer.

Further examples of suitable second polymers include cationic organic polymers obtained by polymerizing a water-soluble ethylenically unsaturated cationic monomer or, preferably, a monomer mixture comprising one or more water-soluble ethylenically unsaturated cationic monomers and optionally one or more other water-soluble ethylenically unsaturated monomers. Examples of suitable cationic monomers include those represented by the above-mentioned general structural formula (I), wherein $R_1$, $R_2$, $R_3$, $R_4$, A, B and $X^-$ are as defined above, and diallyldialkyl ammonium halides, e.g. diallyldimethyl ammonium chloride. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. The monomer mixture can also contain one or more water-soluble ethylenically unsaturated anionic or potentially anionic monomers, preferably in minor amounts. Examples of suitable copolymerizable anionic and potentially anionic monomers include ethylenically unsaturated carboxylic acids and salts thereof, and ethylenically unsaturated sulphonic acids and salts thereof, e.g. any one of those mentioned above. Examples of preferred copolymerizable monomers include acrylamide and methacrylamide, i.e. (meth)acrylamide, and examples of preferred second polymers include cationic acrylamide-based polymer.

Further examples of suitable second polymers include anionic organic polymers obtained by polymerizing a water-soluble ethylenically unsaturated anionic or potentially anionic monomer or, preferably, a monomer mixture comprising one or more water-soluble ethylenically unsaturated anionic or potentially anionic monomers and optionally one or more other water-soluble ethylenically unsaturated monomers. Examples of suitable anionic and potentially anionic monomers include ethylenically unsaturated carboxylic acids and salts thereof, and ethylenically unsaturated sulphonic acids and salts thereof, e.g. any one of those mentioned above. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. The monomer mixture can also contain one or more water-soluble ethylenically unsaturated cationic and potentially cationic monomers, preferably in minor amounts. The term "potentially cationic monomer", as used herein, is meant to include a monomer bearing a potentially ionisable group which becomes cationic when included in a polymer on application to the cellulosic suspension. Examples of suitable copolymerizable cationic and potentially cationic monomers include the monomers represented by the above general structural formula (I) and diallyldialkyl ammonium halides, e.g. diallyldimethyl ammonium chloride. Examples of preferred copolymerizable monomers include (meth)acrylamide, and examples of preferred second polymers include anionic acrylamide-based polymer.

Further examples of suitable second polymers include amphoteric organic polymers obtained by polymerizing a monomer mixture comprising one or more water-soluble ethylenically unsaturated anionic or potentially anionic monomers and one or more water-soluble ethylenically unsaturated cationic or potentially cationic monomers, and optionally one or more other water-soluble ethylenically unsaturated monomers. Examples of suitable anionic and potentially anionic monomers include ethylenically unsaturated carboxylic acids and salts thereof, and ethylenically unsaturated sulphonic acids and salts thereof, e.g. any one of those mentioned above. Examples of suitable cationic and potentially cationic monomers include the monomers represented by the above general structural formula (I) and diallyldialkyl ammonium halides, e.g. diallyldimethyl ammonium chloride. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. Examples of preferred copolymerizable monomers include (meth)acrylamide, and examples of preferred second polymers include amphoteric acrylamide-based polymer.

In preparing suitable second polymers, the monomer mixture can also contain one or more polyfunctional crosslinking agents in addition to the above-mentioned ethylenically unsaturated monomers. The presence of a polyfunctional crosslinking agent in the monomer mixture renders possible preparation of second polymers that are water-dispersible. The polyfunctional crosslinking agents can be non-ionic, cationic, anionic or amphoteric. Examples of suitable polyfunctional crosslinking agents include compounds having at least two ethylenically unsaturated bonds, e.g. N,N-methylene-bis (meth)acrylamide, polyethyleneglycol di(meth)acrylate, N-vinyl (meth)acrylamide, divinylbenzene, triallylammonium salts and N-methylallyl(meth)acrylamide; compounds having an ethylenically unsaturated bond and a reactive group, e.g. glycidyl (meth)acrylate, acrolein and methylol (meth)acrylamide; and compounds having at least two reactive groups, e.g. dialdehydes like glyoxal, diepoxy compounds and epichlorohydrin. Suitable water-dispersible second polymers can be prepared using at least 4 molar parts per million of polyfunctional crosslinking agent based on monomer present in the monomer mixture, or based on monomeric units present in the polymer, preferably from about 4 to about 6,000 molar parts per million, most preferably from 20 to 4,000. Examples of suitable water-dispersible organic polymers include those disclosed in U.S. Pat. No. 5,167,766, which is hereby incorporated herein by reference. Further examples of suitable second polymers include water-dispersible anionic, cationic and amphoteric organic polymers, and preferred second polymers include water-dispersible anionic organic polymers, preferably water-dispersible anionic acrylamide-based polymers.

The second polymers according to the invention, preferably second polymers that are water-soluble, can have a weight average molecular weight of at least about 500,000. Usually, the weight average molecular weight is at least about 1 million, suitably at least about 2 million and preferably at least about 5 million. The upper limit is not critical; it can be about 50 million, usually 30 million.

The second polymer according to the invention can have a charge density less than about 10 meq/g, suitably less than about 6 meq/g, preferably less than about 4 meq/g, more preferably less than 2 meq/g. Suitably, the charge density is in the range of from 0.5 to 10.0, preferably from 1.0 to 4.0 meq/g. Suitable second polymers include anionic organic polymers having a charge density less than 10.0 meq/g, suitably less than 6.0 meq/g, preferably less than 4.0 meq/g. Suitable second polymers further include cationic organic polymers having a charge density less than 6.0 meq/g, suitably less than 4.0 meq/g, preferably less than 2.0 meq/g.

The third polymer according to the present invention is an anionic polymer which can be selected from inorganic and organic anionic polymers. Examples of suitable the third polymers include water-soluble and water-dispersible inorganic and organic anionic polymers.

Examples of suitable third polymers include inorganic anionic polymers based on silicic acid and silicate, i.e., anionic silica-based polymers. Suitable anionic silica-based polymers can be prepared by condensation polymerisation of siliceous compounds, e.g. silicic acids and silicates, which can be homopolymerised or co-polymerised. Preferably, the anionic silica-based polymers comprise anionic silica-based particles that are in the colloidal range of particle size. Anionic silica-based particles are usually supplied in the form of aqueous colloidal dispersions, so-called sols. The silica-based sols can be modified and contain other elements, e.g. aluminium, boron, nitrogen, zirconium, gallium and titanium, which can be present in the aqueous phase and/or in the silica-based particles. Examples of suitable anionic silica-based particles include polysilicic acids, polysilicic acid microgels, polysilicates, polysilicate microgels, colloidal silica, colloidal aluminium-modified silica, polyaluminosilicates, polyaluminosilicate microgels, polyborosilicates, etc. Examples of suitable anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Examples of suitable anionic silica-based particles include those having an average particle size below about 100 nm, preferably below about 20 nm and more preferably in the range of from about 1 to about 10 nm. As conventional in the silica chemistry, the particle size refers to the average size of the primary particles, which may be aggregated or non-aggregated. Preferably, the anionic silica-based polymer comprises aggregated anionic silica-based particles. The specific surface area of the silica-based particles is suitably at least 50 $m^2/g$ and preferably at least 100 $m^2/g$. Generally, the specific surface area can be up to about 1700 $m^2/g$ and preferably up to 1000 $m^2/g$. The specific surface area is measured by means of titration with NaOH as described by G. W. Sears in Analytical Chemistry 28 (1956): 12, 1981-1983 and in U.S. Pat. No. 5,176,891 after appropriate removal of or adjustment for any compounds present in the sample that may disturb the titration like aluminium and boron species. The given area thus represents the average specific surface area of the particles.

In a preferred embodiment of the invention, the anionic silica-based particles have a specific surface area within the range of from 50 to 1000 $m^2/g$, more preferably from 100 to 950 $m^2/g$. Preferably, the silica-based particles are present in a sol having a S-value in the range of from 8 to 50%, preferably from 10 to 40%, containing silica-based particles with a specific surface area in the range of from 300 to 1000 $m^2/g$, suitably from 500 to 950 $m^2/g$, and preferably from 750 to 950 $m^2/g$, which sols can be modified as mentioned above. The S-value is measured and calculated as described by Iler & Dalton in J. Phys. Chem. 60 (1956), 955-957. The S-value indicates the degree of aggregation or microgel formation and a lower S-value is indicative of a higher degree of aggregation.

In yet another preferred embodiment of the invention, the silica-based particles have a high specific surface area, suitably above about 1000 $m^2/g$. The specific surface area can be in the range of from 1000 to 1700 $m^2/g$ and preferably from 1050 to 1600 $m^2/g$.

Further examples of suitable third polymers include water-soluble and water-dispersible organic anionic polymers obtained by polymerizing an ethylenically unsaturated anionic or potentially anionic monomer or, preferably, a monomer mixture comprising one or more ethylenically unsaturated anionic or potentially anionic monomers, and optionally one or more other ethylenically unsaturated monomers. Preferably, the ethylenically unsaturated monomers are water-soluble. Examples of suitable anionic and potentially anionic monomers include ethylenically unsaturated carboxylic acids and salts thereof, ethylenically unsaturated sulphonic acids and salts thereof, e.g. any one of those mentioned above. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. The monomer mixture can also contain one or more water-soluble ethylenically unsaturated cationic and potentially cationic monomers, preferably in minor amounts. Examples of suitable copolymerizable cationic monomers include the monomers represented by the above general structural formula (I) and diallyldialkyl ammonium halides, e.g. diallyldimethyl ammonium chloride. The monomer mixture can also contain one or more polyfunctional crosslinking agents. The presence of a polyfunctional crosslinking agent in the monomer mixture renders possible preparation of third polymers that are water-dispersible. Examples of suitable polyfunctional crosslinking agents including the above-mentioned polyfunctional crosslinking agents. These agents can be used in the above-mentioned amounts. Examples of suitable water-dispersible organic anionic polymers include those disclosed in U.S. Pat. No. 5,167,766, which is incorporated herein by reference. Examples of preferred copolymerizable monomers include (meth)acrylamide, and examples of preferred third polymers include water-soluble and water-dispersible anionic acrylamide-based polymers.

The third polymer being an organic anionic polymer according to the invention, preferably an organic anionic polymer that is water-soluble, has a weight average molecular weight of at least about 500,000. Usually, the weight average molecular weight is at least about 1 million, suitably at least about 2 million and preferably at least about 5 million. The upper limit is not critical; it can be about 50 million, usually 30 million.

The third polymer being an organic anionic polymer can have a charge density less than about 14 meq/g, suitably less than about 10 meq/g, preferably less than about 4 meq/g. Suitably, the charge density is in the range of from 1.0 to 14.0, preferably from 2.0 to 10.0 meq/g.

Examples of preferred drainage and retention aids according to the invention include:

(i) first polymer being cationic acrylamide-based polymer, second polymer being cationic-acrylamide-based polymer, and third polymer being anionic silica-based particles;

(ii) first polymer being cationic polyaluminium compound, second polymer being cationic-acrylamide-based polymer, and third polymer being anionic silica-based particles;

(iii) first polymer being cationic acrylamide-based polymer, second polymer being water-soluble or water-dispersible anionic acrylamide-based polymer, and third polymer being anionic silica-based particles;

(iv) first polymer being cationic polyaluminium compound, second polymer being water-soluble or water-dispersible anionic acrylamide-based polymer, and third polymer being anionic silica-based particles;

(v) first polymer being cationic acrylamide-based polymer, second polymer being cationic-acrylamide-based polymer, and third polymer being water-soluble or water-dispersible anionic acrylamide-based polymer; and (vi) first polymer being cationic polyaluminium compound, second polymer being cationic-acrylamide-based polymer, and third polymer being water-soluble or water-dispersible anionic acrylamide-based polymer.

According to the present invention, the first, second and third polymers are added to the aqueous cellulosic suspension after it has passed through all stages of high mechanical shear and prior to drainage. Examples of high shear stages include pumping and cleaning stages. For instance, such shearing stages are included when the cellulosic suspension is passed through fan pumps, pressure screens and centri-screens. Suitably, the last point of high shear occurs at a centri-screen and, consequently, the first, second and third polymers are suitably added subsequent to the centri-screen. Preferably, after addition of the first, second and third polymers the cellulosic suspension is fed into the headbox which ejects the suspension onto the forming wire for drainage.

It may be desirable to further include additional materials in the process of the present invention. Preferably, these materials are added to the cellulosic suspension before it is passed through the last point of high shear. Examples of such additional materials include starches, e.g. cationic, anionic and amphoteric starch, preferably cationic starch; water-soluble organic polymeric coagulants, e.g. cationic polyamines, polyamideamines, polyethylene imines, dicyandiamide condensation polymers and low molecular weight highly cationic vinyl addition polymers; and inorganic coagulants, e.g. aluminium compounds, e.g. alum and polyaluminium compounds.

The first, second and third polymers can be separately added to the cellulosic suspension. Suitably, the first polymer is added to the cellulosic suspension prior to adding the second and third polymers. The second polymer can be added prior to, simultaneously with or after adding the third polymer. Alternatively, the first polymer is suitably added to the cellulosic suspension simultaneously with the second polymer and then the third polymer is added.

The first, second and third polymers according to the invention can be added to the cellulosic suspension to be dewatered in amounts which can vary within wide limits. Generally, the first, second and third polymers are added in amounts that give better drainage and retention than is obtained when not adding the polymers. The first polymer is usually added in an amount of at least about 0.001% by weight, often at least about 0.005% by weight, calculated as dry polymer on dry cellulosic suspension, and the upper limit is usually about 2.0 and suitably about 1.5% by weight. Likewise, the second polymer is usually added in an amount of at least about 0.001% by weight, often at least about 0.005% by weight, calculated as dry polymer on dry cellulosic suspension, and the upper limit is usually about 2.0 and suitably about 1.5% by weight. Similarly, the third polymer is usually added in an amount of at least about 0.001% by weight, often at least about 0.005% by weight, calculated as dry polymer or dry $SiO_2$ on dry cellulosic suspension, and the upper limit is usually about 2.0 and suitably about 1.5% by weight.

When using starch and/or cationic coagulant in the process, such additives can be added in an amount of at least about 0.001% by weight, calculated as dry additive on dry cellulosic suspension. Suitably, the amount is in the range of from about 0.05 up to about 3.0%, preferably in the range from about 0.1 up to about 2.0%.

The process of this invention is applicable to all papermaking processes and cellulosic suspensions, and it is particularly useful in the manufacture of paper from a stock that has a high conductivity. In such cases, the conductivity of the stock that is dewatered on the wire is usually at least about 1.5 mS/cm, preferably at least 3.5 mS/cm, and more preferably at least 5.0 mS/cm. Conductivity can be measured by standard equipment such as, for example, a WTW LF 539 instrument supplied by Christian Berner.

The present invention further encompasses papermaking processes where white water is extensively recycled, or recirculated, i.e. with a high degree of white water closure, for example where from 0 to 30 tons of fresh water are used per ton of dry paper produced, usually less than 20, preferably less than 15, more preferably less than 10 and notably less than 5 tons of fresh water per ton of paper. Fresh water can be introduced in the process at any stage; for example, fresh water can be mixed with cellulosic fibers in order to form a cellulosic suspension, and fresh water can be mixed with a thick cellulosic suspension to dilute it so as to form a thin cellulosic suspension to which the first, second and third polymers are added.

The process according to the invention is used for the production of paper. The term "paper", as used herein, of course include not only paper and the production thereof, but also other web-like products, such as for example board and paperboard, and the production thereof. The process can be used in the production of paper from different types of suspensions of cellulosic fibers, and the suspensions should preferably contain at least 25% and more preferably at least 50% by weight of such fibers, based on dry substance. The suspensions can be based on fibers from chemical pulp, such as sulphate and sulphite pulp, thermo-mechanical pulp, chemo-thermomechanical pulp, organosolv pulp, refiner pulp or groundwood pulp from both hardwood and softwood, or fibers derived from one year plants like elephant grass, bagasse, flax, straw, etc., and can also be used for suspensions based on recycled fibers. The invention is preferably applied to processes for making paper from wood-containing suspensions.

The suspension also contain mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The stock can of course also contain papermaking additives of conventional types, such as wet-strength agents, sizing agents, such as those based on rosin, ketene dimers, ketene multimers, alkenyl succinic anhydrides, etc.

Preferably the invention is applied on paper machines producing wood-containing paper and paper based on recycled fibers, such as SC, LWC and different types of book and newsprint papers, and on machines producing wood-free printing and writing papers, the term wood-free meaning less than about 15% of wood-containing fibers. Examples of preferred applications of the invention include the production of paper and layer of multilayered paper from cellulosic suspensions containing at least 50% by weight of mechanical and/or recycled fibres. Preferably the invention is applied on paper machines running at a speed of from 300 to 3000 m/min and more preferably from 500 to 2500 m/min.

The invention is further illustrated in the following example which, however, is not intended to limit the same. Parts and % relate to parts by weight and % by weight, respectively, unless otherwise stated.

EXAMPLES

The following additives were used in the examples:

C-PAM 1: Cationic acrylamide-based polymer prepared by polymerisation of acrylamide (40%) and acryloxyethyltrimethyl-ammonium chloride (60 mole %), the polymer having a weight average molecular weight of about 3 million and cationic charge density of about 4.2 meq/g.

C-PAM 2: Cationic acrylamide-based polymer prepared by polymerisation of acrylamide (60 mole %) and acryloxyethyltrimethyl ammonium chloride (40 mole %), the polymer having a weight average molecular weight of about 3 million and cationic charge of about 3.3 meq/g.

C-PAM 3: Cationic acrylamide-based polymer prepared by polymerisation of acrylamide (88 mole %), acryloxyethyltrimethyl ammonium chloride (10 mole %) and dimethyl acrylamide (2 mole %), the polymer having a weight average molecular weight of about 6 million and cationic charge density of about 1.2 meq/g.

C-PAM 4: Cationic acrylamide-based polymer prepared by polymerisation of acrylamide (90 mole %) and acryloxyethyltrimethyl ammonium chloride (10 mole %), the polymer having a weight average molecular weight of about 6 million and cationic charge density of about 1.2 meq/g.

PAC: Cationic polyaluminium chloride with a cationic charge density of about 8.0 meq/g.

C-PAI 1: Cationic polyamine having a weight average molecular weight of about 200,000 and cationic charge density of about 7 meq/g.

C-PAI 2: Cationic polyamine having a weight average molecular weight of about 400,000 and cationic charge density of about 7 meq/g.

A-PAM: Anionic acrylamide-based polymer prepared by polymerisation of acrylamide (80 mole %) and acrylic acid (20 mole %), the polymer having a weight average molecular weight of about 12 million and anionic charge density of about 2.6 meq/g.

A-X-PAM: Anionic cross-linked acrylamide-based polymer prepared by polymerisation of acrylamide (30 mole %) and acrylic acid (70 mole %), the polymer having a weight average molecular weight of about 100,000 and anionic charge density of about 8.0 meq/g.

Silica: Anionic inorganic condensation polymer of silicic acid in the form of colloidal aluminium-modified silica sol having an S value of about 21 and containing silica-based particles with a specific surface area of about 800 $m^2/g$.

Betonite: Bentonite

Example 1

Drainage (dewatering) performance was evaluated by means of a Dynamic Drainage Analyser (DDA), available from Akribi, Sweden, which measures the time for draining a set volume of stock through a wire when removing a plug and applying vacuum to that side of the wire opposite to the side on which the stock is present.

The stock used in the tests was based on 75% TMP and 25% DIP fibre material and sedimented white water from a newsprint mill. Stock consistency was 0.78%. Conductivity of the stock was 1.5 mS/cm and pH was 6.8.

In order to simulate additions after all points of high shear, the stock was stirred in a baffled jar at different stirrer speeds. Stirring and additions were made according to the following:

(i) stirring at 1000 rpm for 20 seconds, (ii) stirring at 2000 rpm for 10 seconds, (iii) stirring at 1000 rpm for 15 seconds while making additions, and (iv) dewatering the stock while automatically recording the dewatering time.

Additions to the stock were made as follows: The first addition (addition level of 0.5 kg/t) was made 15 seconds prior to dewatering, the second addition (addition level of 0.8 kg/t) was made 10 seconds prior to dewatering and the third addition (addition level of 0.5 kg/t) was made 5 seconds prior to dewatering.

Table 1 shows the dewatering times at different modes of addition. The polymer and bentonite addition levels were calculated as dry product on dry stock system, and the sol of 30 silica-based particles were calculated as Si02 and based on dry stock system.

Test No. 1 shows the result without any additives. Test Nos. 2 to 4 illustrate processes used for comparison and Test Nos. 5 to 7 illustrate processes according to the invention.

TABLE 1

| Test No. | First Addition | Second Addition | Third Addition | Dewatering Time [s] |
|---|---|---|---|---|
| 1 | — | — | — | 60.6 |
| 2 | C-PA11 | C-PAM 4 | Bentonite | 24.5 |
| 3 | C-PAI 1<br>C-PAI 2 (1:1) | C-PAM 4 | Bentonite | 24.4 |
| 4 | — | C-PAM 4 | Bentonite | 32.4 |
| 5 | C-PAM 1 | C-PAM 3 | Silica | 22.4 |
| 6 | C-PAM 2 | C-PAM 4 | Silica | 21.2 |
| 7 | C-PAM 2 | C-PAM 3 | Silica | 19.0 |

Table 1 shows that the process according to the present invention resulted in Improved dewatering.

Example 2

Drainage performance was evaluated using the DDA according to Example 1.

The stock used in the test was based on 75% TMP and 25% DIP fibre material and bleach water from a paper mill. Stock consistency was 0.77%. Conductivity of the stock was 1.6 mS/cm and pH was 7.2.

In order to simulate additions prior to and after all points of high shear, the stock was stirred in a baffled jar at different stirrer speeds. Stirring and additions were made according to the following:

(i) stirring at 1000 rpm for 25 seconds while making from 0 to 2 additions, (ii) stirring at 2000 rpm for 10 seconds, (iii) stirring at 1000 rpm for 15 seconds while making from 0 to 3 additions, and (iv) dewatering the stock while automatically recording the dewatering time.

Additions to the stock were made as follows: The first addition, if any, was made 45 or 15 seconds prior to dewatering, the second addition, if any, was made 25 or 10 seconds prior 25 to dewatering and the third addition, if any, was made 5 seconds prior to dewatering.

Table 2 shows the dewatering times at different modes of addition. Addition times are given in seconds prior to dewatering and addition levels are given in kg/t for the first, second and third additions (1st/2nd/3rd), respectively. The polymer addition levels were calculated as dry product on dry stock system, and the silica-based particles were calculated as $SiO_2$ and based on dry stock system.

Test No. 1 shows the result without any additives. Test Nos. 2 to 7 illustrate processes used for comparison and Test Nos. 8 to 10 illustrate processes according to the invention.

TABLE 2

| Test No. | First Addition | Second Addition | Third Addition | Addition Times [s] $1^*/2^{nd}/3^{rd}$ | Addition Levels [kg/t] $1^{st}/2^{nd}/3^{nJ}$ | Dewatering Time [s] |
|---|---|---|---|---|---|---|
| 1 | — | — | — | — | — | 84.0 |
| 2 | C-PAM 2 | C-PAM 4 | Silica | 45/25/5 | 0.1/0.2/0.5 | 61.8 |
| 3 | C-PAM 2 | C-PAM 4 | Silica | 45/25/5 | 0.2/0.2/0.5 | 50.2 |
| 4 | C-PAM 2 | C-PAM 4 | Silica | 45/25/5 | 0.1/0.5/0.5 | 39.0 |

TABLE 2-continued

| Test No. | First Addition | Second Addition | Third Addition | Addition Times [s] $1^{st}/2^{nd}/3^{rd}$ | Addition Levels [kg/t] $1^{st}/2^{nd}/3^{rd}$ | Dewatering Time [s] |
|---|---|---|---|---|---|---|
| 5 | C-PAM 2 | C-PAM 4 | Silica | 45/10/5 | 0.1/0.2/0.5 | 56.0 |
| 6 | C-PAM 2 | C-PAM 4 | Silica | 45/10/5 | 0.2/0.2/0.5 | 46.0 |
| 7 | C-PAM 2 | C-PAM 4 | Silica | 45/10/5 | 0.1/0.5/0.5 | 32.1 |
| 8 | C-PAM 2 | C-PAM 4 | Silica | 15/10/5 | 0.1/0.2/0.5 | 48.2 |
| 9 | C-PAM 2 | C-PAM 4 | Silica | 15/10/5 | 0.2/0.2/0.5 | 43.8 |
| 10 | C-PAM 2 | C-PAM 4 | Silica | 15/10/5 | 0.1/0.5/0.5 | 31.0 |

It is evident from Table 2 that the process according to the present invention resulted in improved dewatering.

Example 3

Drainage performance was evaluated according to the procedure of Example 2.

Retention performance was evaluated by means of a nephelometer, available from Novasina, Switzerland, by measuring the turbidity of the filtrate, the white water, obtained by draining the stock. The turbidity was measured in NTU (Nephelometric Turbidity Units).

The stock and modes of stirring and addition used in Example 2 were similarly used in this example.

Table 3 shows the dewatering effect at different modes of addition. Test No. 1 shows the result without any additives. Test Nos. 2 and 3 illustrate processes used for comparison and Test No. 4 illustrates the process according to the invention.

TABLE 3

| Test No. | First Addition | Second Addition | Third Addition | Addition Times [s] $1^{st}/2^{nd}/3^{rd}$ | Addition Levels [kg/t] $1^{st}/2^{nd}/3^{rd}$ | Dewatering Time [s] | Turbidity [NTU] |
|---|---|---|---|---|---|---|---|
| 1 | — | — | — | — | — | 84.0 | 100 |
| 2 | C-PAM 2 | A-PAM | Silica | 45/25/5 | 0.8/0.2/0.5 | 66.0 | 31 |
| 3 | C-PAM 2 | A-PAM | Silica | 45/10/5 | 0.8/0.2/0.5 | 61.9 | 32 |
| 4 | C-PAM 2 | A-PAM | Silica | 15/10/5 | 0.8/0.2/0.5 | 53.2 | 26 |

Table 3 shows that process of the present invention resulted in improved drainage 10 performance.

Example 4

Drainage and retention performance was evaluated according to the procedure of Example 15 3. The stock and modes of stirring and addition used in Example 2 were similarly used in this example.

Table 4 shows the dewatering effect at different modes of addition. Test No. 1 shows the result without any additives. Test Nos. 2 to 7 illustrate processes used for comparison and 20 Test Nos. 8-9 illustrate processes according to the invention.

TABLE 4

| Test No. | First Addition | Second Addition | Third Addition | Addition Times [s] $1^{st}/2^{nd}/3^{rd}$ | Addition Levels [kg/t] $1^{st}/2^{nd}/3^{rd}$ | Dewatering Time [s] | Turbidity [NTU] |
|---|---|---|---|---|---|---|---|
| 1 | — | — | — | — | — | 84.0 | 100 |
| 2 | C-PAM 2 | — | A-PAM | 45/—/5 | 0.2/—/0.3 | 148.0 | 76 |
| 3 | C-PAM 2 | — | A-PAM | 15/—/5 | 0.2/—/0.3 | 162.4 | 58 |
| 4 | — | C-PAM 4 | A-PAM | —/25/5 | —/0.8/0.3 | 101.0 | 18 |
| 5 | — | C-PAM 4 | A-PAM | —/10/5 | —/0.8/0.2 | 82.2 | 26 |
| 6 | C-PAM 2 | C-PAM 4 | A-PAM | 45/25/5 | 0.2/0.8/0.2 | 77.4 | 20 |
| 7 | C-PAM 2 | C-PAM 4 | A-PAM | 45/10/5 | 0.2/0.8/0.3 | 60.0 | 22 |

TABLE 4-continued

| Test No. | First Addition | Second Addition | Third Addition | Addition Times [s] $1^{st}/2^{nd}/3^{rd}$ | Addition Levels [kg/t] $1^{st}/2^{nd}/3^{rd}$ | Dewatering Time [s] | Turbidity [NTU] |
|---|---|---|---|---|---|---|---|
| 8 | C-PAM 2 | C-PAM 4 | A-PAM | 15/10/5 | 0.2/0.8/0.2 | 49.0 | 17 |
| 9 | C-PAM 2 | C-PAM 4 | A-PAM | 15/10/5 | 0.2/0.8/0.3 | 52.5 | 20 |

Table 4 shows that the process according to the present invention resulted in improved drainage (dewatering) and retention performance.

Example 5

Drainage and retention performance was evaluated according to the procedure of Example 3.

The modes of stirring and addition used in Example 2 were similarly used in this example.

The stock used in this example was based on 75% TMP and 25% DIP fibre material and bleach water from a newsprint mill. Stock consistency was 0.82%. Conductivity of the stock was 1.7 mS/cm and pH was 7.2.

Table 5 shows the dewatering effect at different modes of addition. Test No. 1 shows the result without any additives. Test Nos. 2 to 8 illustrate processes used for comparison and Test No. 9 illustrates the process according to the invention.

TABLE 5

| Test No. | First Addition | Second Addition | Third Addition | Addition Time [s] $1^{st}/2^{nd}/3^{rt}$ | Addition Levels [kg/t] $1^{st}/2^{nd}/3^{rt}$ | Dewatering Time [s] | Turbidity [NTU] |
|---|---|---|---|---|---|---|---|
| 1 | — | — | — | — | — | 93.9 | 82 |
| 2 | — | C-PAM 4 | Silica | —/25/5 | —/0.2/0.5 | 67.7 | 58 |
| 3 | — | C-PAM 4 | Silica | -MO/5 | —/0.2/0.5 | 60.7 | 68 |
| 4 | PAC | — | Silica | 45/—/5 | 2/—/0.5 | 88.5 | 62 |
| 5 | PAC | — | Silica | 15/—/5 | 2/—/0.5 | 83.5 | 73 |
| 6 | PAC | C-PAM 4 | — | 45/25/— | 2/0.2/— | 51.8 | 52 |
| 7 | PAC | C-PAM 4 | — | 45/10/— | 2/0.2/— | 54.5 | 56 |
| 8 | PAC | C-PAM 4 | Silica | 45/10/5 | 2/0.2/0.5 | 54.6 | 51 |
| 9 | PAC | C-PAM 4 | Silica | 15/10/5 | 2/0.2/0.5 | 51.2 | 48 |

Table 5 shows that the process according to the present invention resulted in improved drainage (dewatering) and retention performance.

Example 6

Drainage performance was evaluated according to the procedure of Example 2. The stock and modes of stirring and addition used in Example 5 were similarly used in this example.

Table 6 shows the dewatering effect at different modes of addition. Test No. 1 shows the result without any additives. Test Nos. 2 to 6 illustrate processes employing additives used for comparison (Ref.) and Test No. 7 illustrates the process according to the invention.

TABLE 6

| Test No. | First Addition | Second Addition | Third Addition | Addition Time [s] $1^{s*}/2^{nd}/3_{«}$ | Addition Levels [kg/t] $1^{6l}/2^{nd}/3^{nf}$ | Dewatering Time [s] |
|---|---|---|---|---|---|---|
| 1 | — | — | — | — | — | 93.9 |
| 2 | PAC | C-PAM 4 | — | 45/25/— | 2/0.2/— | 51.8 |
| 3 | PAC | C-PAM 4 | — | 45/10/— | 2/0.2/— | 54.5 |
| 4 | PAC | C-PAM 4 | — | 15/10/— | 2/0.2/— | 48.7 |

TABLE 6-continued

| Test No. | First Addition | Second Addition | Third Addition | Addition Time [s] $1^{st}/2^{nd}/3_{«}$ | Addition Levels [kg/t] $1^{6l}/2^{nd}/3^{nf}$ | Dewatering Time [s] |
|---|---|---|---|---|---|---|
| 5 | PAC | C-PAM 4 | A-X-PAM | 45/25/5 | 2/0.2/0.1 | 44.8 |
| 6 | PAC | C-PAM 4 | A-X-PAM | 45/10/5 | 2/0.2/0.1 | 43.9 |
| 7 | PAC | C-PAM 4 | A-X-PAM | 15/10/5 | 2/0.2/0.1 | 42.9 |

Table 6 shows that the process according to the invention resulted in improved dewatering performance.

Example 7

Drainage performance was evaluated according to the procedure of Example 2. The stock and modes of stirring and addition used in Example 5 were similarly used in this example.

Table 7 shows the dewatering effect at different modes of addition. Test No. 1 shows the result without any additives. Test Nos. 2 to 7 illustrate processes used for comparison and Test No. 8 illustrates the process according to the invention.

TABLE 7

| Test No. | First Addition | Second Addition | Third Addition | Addition Time [s] $1^{st}/2^{nd}/3^{*}$ | Addition Levels [kg/t] $1_{«}/2^{nd}/3^{ld}$ | Dewatering Time [s] |
|---|---|---|---|---|---|---|
| 1 | — | — | — | — | — | 93.9 |
| 2 | PAC | — | A-PAM | 45/—/5 | 0.2/—/0.1 | 185.0 |
| 3 | PAC | — | A-PAM | 15/—/5 | 0.2/—/0.1 | 96.8 |
| 4 | — | C-PAM 4 | A-PAM | −12515 | —/0.8/0.1 | 76.5 |
| 5 | — | C-PAM 4 | A-PAM | —/10/5 | —/0.8/0.1 | 55.1 |
| 6 | PAC | C-PAM 4 | A-PAM | 45/25/5 | 0.2/0.8/0.1 | 107.0 |
| 7 | PAC | C-PAM 4 | A-PAM | 45/10/5 | 0.2/0.8/0.1 | 61.5 |
| 8 | PAC | C-PAM 4 | A-PAM | 15/10/5 | 0.2/0.8/0.1 | 39.8 |

Table 7 shows that the process according to the invention resulted in improved dewatering performance.

The invention claimed is:

1. A process for producing paper which comprises:

(i) providing an aqueous suspension comprising cellulosic fibres, (ii) adding to the suspension after all points of high shear at least:

a first polymer being polvaluminium chloride;

a second polymer being a water-soluble acrylamide-based polymer; and a third polymer being an inorganic anionic polymer selected from silicic acid or silicate based polymers, with the proviso that the third polymer is not bentonite;

and wherein the second acrylamide-based polymer is formed from a reaction mixture which is essentially free from polyfunctional crosslinking agents, (iii) dewatering the obtained suspension to form paper.

2. The process of claim 1, wherein the second polymer has a weight average molecular weight above about 2,000,000.

3. The process of claim 1, wherein the second polymer has a weight average molecular weight above about 5,000,000.

4. The process of claim 1, wherein the second polymer has a weight average molecular weight above about 5,000,000 up to about 50 million.

5. The process of claim 1, wherein the second polymer has a charge density in the range of from 0.5 to 10.0 meq/g.

6. The process of claim 1, wherein the second polymer has a charge density in the range of from 1.0 to 4.0 meq/g.

7. The process of claim 1, wherein the third polymer is an inorganic anionic polymer selected from silicic acid or silicate based polymers comprising colloidal silica-based particle.

8. The process of claim 1, wherein the third polymer is an inorganic anionic polymer selected from silicic acid or silicate based polymers comprising colloidal silica-based particle, the silica-based particles comprising aggregated particles having an average particle size in the range of from 1 to 10 nm.

9. The process of claim 1, wherein the points of high shear are selected from fan pumps, pressure screens, and centri-screens.

10. The process of claim 1, wherein the first, second and third polymers are added subsequent to a centri-screen being the last point of high shear.

11. A process for producing paper which comprises:

(i) providing an aqueous suspension comprising cellulosic fibres, (ii) adding to the suspension after all points of high shear at least:

a first polymer being polvaluminium chloride;

a second polymer being a cationic water-soluble acrylamide-based polymer having a weight average molecular weight of above about 5,000,000, and a charge density in the range of from 0.5 to 4.0 meq/g; and a third polymer being an inorganic anionic polymer selected from silicic acid or silicate based polymers comprising colloidal silica-based particle, the silica-based particles comprising aggregated particles having an average particle size in the range of from 1 to 10 nm, the particles being present in a sol having an S-value in the range of from 8 to 50%, with the proviso that the third polymer is not bentonite; and wherein the second acrylamide-based polymer is formed from a reaction mixture which is essentially free from polyfunctional crosslinking agents dewatering the obtained suspension to form paper.

12. The process of claim 11, wherein the first polymer has a charge density above about 4.0 meq/g.

13. The process of claim 11, wherein the second acrylamide-based polymer is formed from a reaction mixture which is free from polyfunctional crosslinking agents.

14. A process for producing paper which comprises:

(i) providing an aqueous suspension comprising cellulosic fibres, (ii) adding to the suspension after all points of high shear at least:

a first polymer being polyaluminium chloride having a charge density above about 2.5 meq/g;

a second polymer being a cationic water-soluble acrylamide-based polymer having a weight average molecular weight of above about 500,000; and a third polymer being an inorganic anionic polymer selected from silicic acid or silicate based polymers, with the proviso that the third polymer is not bentonite;

and wherein the second acrylamide-based polymer is formed from a reaction mixture which is essentially free from polyfunctional crosslinking agents dewatering the obtained suspension to form paper.

15. The process of claim 14, wherein the first polymer has a charge density of above about 4.0 meq/g.

16. The process of claim 14, wherein the second polymer has a weight average molecular weight of above about 2,000,000.

17. The process of claim 14, wherein the first, second and third polymers are added subsequent to a centri-screen being the last point of high shear.

* * * * *